United States Patent [19]

Kostylev et al.

[11] Patent Number: 4,516,662

[45] Date of Patent: May 14, 1985

[54] ROD-CLAMPING MEANS OF A PERCUSSIVE AIR TOOL FOR DRIVING INTO THE GROUND AND REMOVING THEREFROM ROD-LIKE PIECES

[76] Inventors: Alexandr D. Kostylev, ulitsa Derzhavina 18, kv. 44; Jury N. Syryamin, ulitsa D. Kovalchuk, 266/1, kv. 51; Boris N. Smolyanitsky, ulitsa O. Dundicha, 27, kv. 18; Vladimir P. Boginsky, ulitsa Tsvetnoi proezd, 17, kv. 62; Alexei D. Terskov, ulitsa Ippodromskaya, 31, kv. 154, all of Novosibirsk, U.S.S.R.

[21] Appl. No.: 469,577

[22] Filed: Feb. 24, 1983

[30] Foreign Application Priority Data

Mar. 1, 1982 [SU] U.S.S.R. ..... 3402727

[51] Int. Cl.[3] ..... E21B 1/00

[52] U.S. Cl. ..... 173/53; 173/92; 173/149

[58] Field of Search ..... 173/53–56, 173/92, 148–151; 279/19.2, 19.6, 1 B, 28, 29; 83/698

[56] References Cited

U.S. PATENT DOCUMENTS

| | | | |
|---|---|---|---|
| 1,883,070 | 10/1932 | Stone | 173/149 |
| 3,722,603 | 3/1973 | Brown | 173/149 |
| 3,792,869 | 2/1974 | Braun | 173/149 |
| 4,298,074 | 11/1981 | Mattchen | 279/28 |

FOREIGN PATENT DOCUMENTS

| | | | |
|---|---|---|---|
| 3026861 | 2/1982 | Fed. Rep. of Germany | 173/53 |

*Primary Examiner*—James M. Meister
*Assistant Examiner*—John L. Knoble
*Attorney, Agent, or Firm*—Burgess, Ryan & Wayne

[57] ABSTRACT

A rod-clamping device comprises an impact load transmission assembly which includes a housing having a through axial cavity and a system of jamming elements, a rocoil force take up assembly which includes a housing having a through axial cavity, a collar sleeve, and a system of jamming elements, and a resilient element adapted to urge the jamming elements in a direction counter to the forces being exerted, the impact load transmission assembly having a sleeve member, each system of the jamming elements in the two assemblies being forced to the housing and the rod being driven by a separate resilient element.

9 Claims, 6 Drawing Figures

ROD-CLAMPING MEANS OF A PERCUSSIVE AIR TOOL FOR DRIVING INTO THE GROUND AND REMOVING THEREFROM ROD-LIKE PIECES

This invention relates generally to civil engineering, and more particularly to rod-clamping means of devices for driving into the ground and removing therefrom rod-like pices.

The device according to the invention can find application for driving into the ground and removing therefrom elongated rod-like pieces, especially flexible rod-like pieces.

There is known a rod-clamping means of a device for driving into the ground earthing electrodes which comprises ahousing having a through tapered interior accommodating jamming elements, and a spring providing for a continuous contact of the jamming elements with the housing and a rod being driven. This rod-clamping means is geared to a hydraulic power cylinder which is attached, such as by braces, to a power transmission line support to force the rod into the ground when hydraulic fluid is fed to the upper chamber of the power cylinder and move the rod-clamping means to its initial position when the fluid is fed to the lower chamber thereof.

This known rod-clamping means is fixedly secured to the movable shaft of the power cylinder to transmit a driving force to the rod by virtue of the rod tending to lock under the wedging action produced during the downward movement of the shaft. The reaction force of the ground exerted to the housing of the power cylinder is taken up by the power transmission line support to which the housing of the power cylinder is rigidly affixed.

When the rod-clamping means moves closer to the ground surface, the hydraulic fluid is valved to the lower chamber of the power cylinder, whereby the shaft moves to the initial upper position relative to the stationary rod held in the ground by the forces of friction and the power cylinder attached to the power transmission line support.

In the initial upper position of the shaft with the rod-clamping means, the hydraulic fluid is valved to the upper chamber of the power cylinder. Therewith, the piston of the power cylinder and the shaft rigidly connected to the rod-clamping means start their downward travel. The rod is therefore wedged in the rod-clamping means to be driven into the ground at a distance equal to the piston stroke of the power cylinder; this cycle being repeated until the rod is completely driven into the ground.

Inherent in the above construction of the rod-clamping means is a disadvantage residing in that it is capable of transmitting driving force only in one direction. i.e. toward the larger base of the tapered interior of the housing or only for the downward travel of the rod. The aforedescribed prevents the use of the device with vibration or percussive mechanisms characterized, as is known, by alternating forces exerted to housings of such mechanisms and requiring a fixed connection of the housings to the rods in the course of driving the rods into the ground.

Also known is a rod-clamping means for driving rod-like pieces into the ground by vibration mechanisms in which the housing of such means is provided with two cone-shaped sleeves with smaller bases of the cones facing each other. The interiors of the cone-shaped sleeves accomodate spring-biased jamming elements in the form of spheres or balls separated by upper and lower separating partitions. The upper separating partition is connected through a shank to one end of an arm member, whereas secured on the other end of the arm in seats are springs, a cable of a hoisting mechanism being further attached to this second end of the arm member.

The suspended vibrator with the rod-clamping means secured thereto bears by the arms on weights fixed to the cables. In such a state the springs are compressed at a distance substantially equal to the arm travel, the upper separating partition and the balls of the upper conical sleeve being raised to render the rod-clamping means unlocked. The rod is then passed through a bore of the vibrator and the rod-clamping means. When tension is relieved from the cables, the rod-clamping means is locked under the action of the weight of the vibrator and the force of springs urging by the separating partitions the balls between the tapered surfaces of the sleeves and the rod to be driven. Therewith, the balls of the lower conical sleeve impart a driving force to the rod, whereas the balls of the upper conical sleeve act to transmit the reactive force of the vibrator, which tends to prevent the movement of the rod-clamping means in respective downward or upward directions.

Engagement of the vibrator initiates the driving action of the rod accompanied by the travel of the rod-clamping means locked on the rod and the vibrator toward the ground surface.

When the rod-clamping means touches the ground surface, the hoisting mechanism is put into action to unlock it and remove it to its initial position, the arms acting to move the upper separating partition upwards and thereby release the rod.

Among disadvantages of the above rod-clamping means are its structural complication, excessive weight and size, and the need to use the hoisting mechanism for unlocking the rod-clamping means and moving the rod driving device into initial position. In addition, the rod-clamping means of the aforedescribed construction fails to provide for removing rods from the ground.

Another prior art rod-clamping means of a percussive air tool for driving into the ground and removing therefrom rod-like pieces comprises an assembly for transmitting impact loads to the rod being driven which includes a housing having a substantially conical interior and jamming elements having tapered outer surfaces, and an assembly for taking up recoil forces of the percussive air tool which includes a housing having a conical interior, jamming elements with tapered outer surfaces, a thrust sleeve secured in the lower portion of the housing, and a stop means adapted to limit the axial displacement of the thrust sleeve. The two housings are interconnected by the larger bases of their conical interiors. A coil spring is provided between the jamming elements of the impact load transmission and recoil force take up assemblies, the spring acting to urge the jamming elements to the housing and the rod being driven.

The rod is first passed through the rod-clamping means, for which purpose the jamming elements of the recoil force take up assembly are shifted by the thrust sleeve, whereas under the action of the weight of the percussive air tool and the force exerted by the spring the jamming elements of the impact load transmission assembly lock the rod relative to the housing to thereby prevent the percussive air tool from sliding downwards.

During operation of the percussive air tool impact loads are transmitted to the rod through the housing and the jamming elements of the impact load transmission assembly, whereas the recoil force is taken up by the housing and the jamming elements pressed thereto and to the rod by the coil spring of the recoil force take up assembly.

When the percussive air tool secured on the rod being driven approaches the ground surface, the thrust sleeve bears thereon to compress the coil spring and unlock the jamming elements of the recoil force take up assembly. Because the impact load transmission assembly fails to take up the recoil forces, then under the action of such forces the percussive air tool moves upwards of the rod until it is fixed in position by the jamming elements of the recoil force take up assembly.

In order to remove the rod from the ground, the recoil force take up assembly is disengaged by moving the thrust sleeve to displace the jamming elements of this assembly and fix the thrust sleeve and the jamming elements in such a position. Thereafter, the percussive air tool is mounted on the rod with the rod-clamping means facing upwards, whereby only impact loads tending to retract the rod from the ground are imparted thereto. Since the recoil forces fail to be taken up by the rod-clamping means, the percussive air tool rests near the ground surface rather than moves together with the rod being retracted.

The above known rod-clamping means also suffers from disadvantages residing in the lack of a stable contact between the jamming elements and the housing of the two assemblies when the diameters of rods to be driven varies due to the variable curvatures of the tapering surfaces, which entails reduced radial rigidity of the rod-clamping means and less reliable locking action thereof. Further, the provision of only one coil spring fails to press the jamming elements both to the housing and the rod in an optimized manner for each of the two assemblies. And finally, the jamming elements may fall inside the housings to hamper the insertion of the rodinto the rod-clamping means, which also affects the efficiency of rod driving operations.

It is the principle object of this invention to provide a rod-clamping means capable of reliable rod locking and unlocking actions and featuring high radial clamping rigidity.

Another object is to prevent jamming elements of the rod-clamping means according to the invention from falling inside the housings, which would result in a higher rod driving efficiency.

These objects and other attending advantages of the invention are attained by that in a rod-clamping means of a percussive air tool for driving into the ground and removing therefrom substantially rod-like pieces comprising an assembly for transmitting impact loads to the rod being driven which includes a housing with an axial through cavity and a system of jamming elements, an assembly for taking up recoil forces of the percussive air tool which includes a housing having an axial through cavity, a collar sleeve, a system of jamming elements, and a resilient means acting to urge the jamming elements in a direction counter to the forces being exerted, according to the invention, the impact load transmission assembly has a sleeve, whereas each system of the jamming elements in the two assemblies is pressed against the housing thereof and the rod being driven by separate resilient means.

One possible modified form of the present invention provides that the sleeves of the two assemblies of the prior art rod-clamping means have windows adapted to receive the jamming elements, these jamming element having in turn projecting portions.

Preferably, the inner surfaces of the housings of the two assemblies have inclined grooves adapted to slidingly receive the projecting portions of the jamming elements.

Advisably, in the impact load transmission assembly a resilient means is installed between the jamming elements and the sleeve, whereas in the recoil force take up assembly such a means is interposed between the housing and the collar sleeve.

Preferably, the impadt load transmission assembly and the recoil force take up assembly are so interconnected the grooves provided in their respective housings are inclined in the opposite directions.

An alternative embodiment of the invention provides that the recoil force take up assembly is arranged in the rear portion of the percussive air tool, the resilient means thereof having the form of a flexible membrane defining with the housing of this assembly a chamber communicable with a source of compressed air, the grooves provided in the housings of the impact load transmission and recoil force take up assemblies being inclined in one direction.

Preferably, the mating surfaces of the inclined grooves and the projections of the jamming elements are flat.

Alternatively, the mating surfaces of the inclined grooves and the projections of the jamming elements are cylindrical with equal radius of curvature.

The above construction of the rod-clamping means assures highly reliable rod locking and unlocking actions resulting in more efficient rod driving operation.

The essence of the invention resides in the provision of a continuous contact between the jamming elements and the housings irrespective of the diameter of the rods being driven attained by that the surfaces of the inclined grooves provided on the inner surfaces of the housings and the mating surfaces of the projections of the jamming elements slidingly received by these grooves are either flat or cylindrical with an equal radius of curvature.

In view of the above fact, irrespective of the diameter of rods to be driven displacement of the jamming elements provides for a reliable and continuous contact thereof with the housings of the assemblies and the rods being driven into the ground.

In addition, the provision of the sleeve in the impact load transmission assembly, as well as the provision of windows in the sleeves to receive the jamming elements assures a more accurate displacement of the jamming elements in the inclined grooves and prevents the jamming elements from falling inside the housings during insertion of the rods to be driven.

The provision of the impact load transmission and recoil force take up assemblies with individual resilient means makes it possible to force each system of the jamming elements to the housing and the rod with an optimized force.

In order to ensure controllable functioning of the jamming elements of recoil force take up means, the resilient means thereof has the form of a flexible membrane defining with the housing a chamber communicable with a source of compressed air, the grooves of the two housings being inclined in one direction. The above provides for reliable locking and unlocking actions at required points during rod driving and removing operations along with displacement of the percussive air tool on the rod at a distance ensuring a maximum efficiency.

The application of the herein proposed invention makes it possible to increase the efficiency of driving rod-like pieces into the ground by 1.5 to 2.0 times through the provision of highly stable rod locking and unlocking actions, ensuring the controllability of the rod driving operations and reliable fixation of the jamming elements in the housings of the two assemblies.

Other objects and attending advantages of the present invention will become more fully apparent from a detailed description that follows taken in conjunction with the accompanying drawings illustrating some preferred embodiments thereof, in which drawings.

Figure 1:
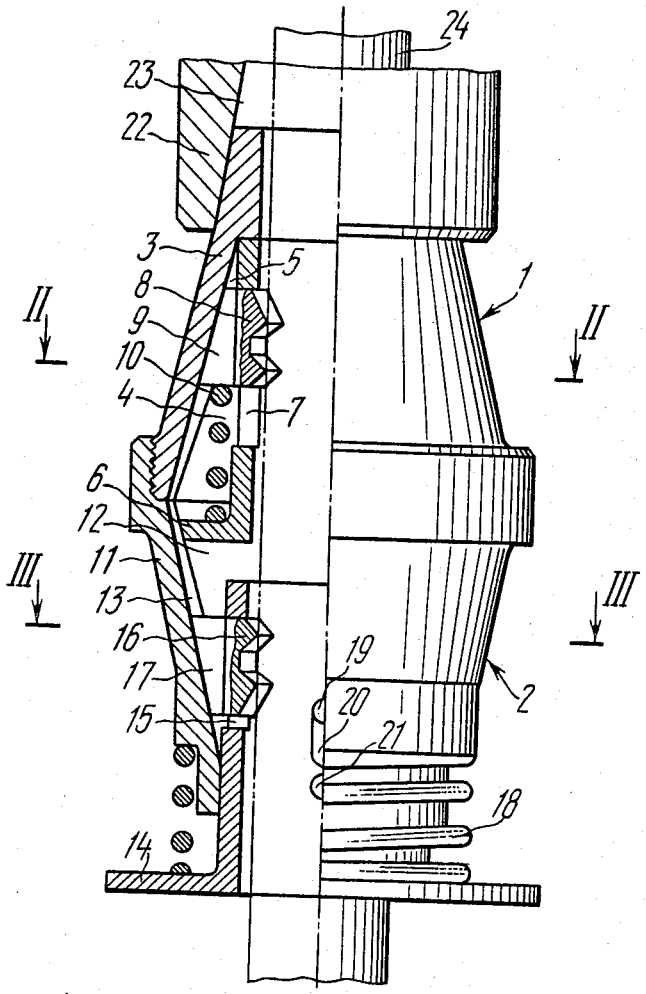
FIG. 1 is a schematic illustration of a rod-clamping means of a percussive air tool for driving into the ground and removing therefrom rod-like pieces.
Figure 2:
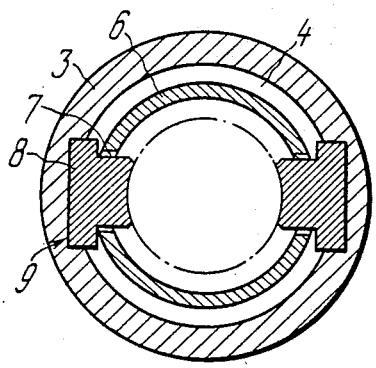
FIG. 2 is a cross-section taken along the line II—II in FIG. 1.
Figure 3:
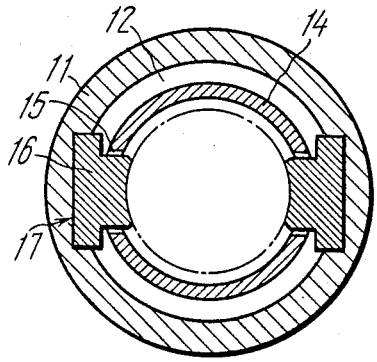
FIG. 3 is a cross-section taken along the line III—III in FIG. 1.

A rod-clamping means of a percussive air tool for driving into the ground and retracting therefrom substantially rod-like pieces with reference to FIGS. 1, 2 and 3 comprises an impact load transmission assembly 1 and a recoil force take up assembly 2.

The impact load transmission assembly 1 comprises a housing 3 having a through axial cavity 4 the inner surface of which is provided with inclined grooves 5. Disposed inside the axial cavity 4 is a sleeve 6 having windows 7 on the side surface thereof. Jamming elements 8 having projections 9 adapted to move inside the inclined grooves 5 of the housing 3 are received by the windows 7 of the sleeve 6, the inner surfaces of the inclined grooves 5 and the mating surfaces of the projections 9 of the jamming elements 8 being flat or planar. Interposed between the jamming elements 8 and the sleeve 6 is a compression spring 10.

The recoil force take up assembly 2 comprises a housing 11 having a through axial cavity 12 the inner surface of which is provided with inclined grooves 13. Disposed inside the cavity 12 is a collar sleeve 14 having windows 15 on the side surface thereof. Jamming elements 16 having projections 17 slidable in the inclined grooves 13 of the housing 11 are received by the windows 15. The inner surfaces of the inclined grooves 13 and the mating surfaces of the projections 17 of the jamming elements 16 are flat. A coil spring 18 is likewise interposed between the collar sleeve 14 and the housing 11.

The housings 3 and 11 are so interconnected that the grooves 5 and 13 are inclined in the opposite directions.

An axial through bore 23 serves to connect the housing 3 of the impact load transmission assembly 1 with the percussive air tool 22, this bore 23 also accommodating a rod piece 24.

The rod-clamping means according to the invention operates as follows.

The percussive air tool 22 and the rod-clamping means are placed substantially vertically on the ground. Therewith, the collar sleeve 14 bears against the ground by its collar portion to move relative to the housing 11 of the recoil force take up assembly 2 and shift the jamming elements 16 upwards thereby causing them to move apart or increase the spacing therebetween.

The rod 24 is inserted into the percussive air tool and passed through the rod-clamping means forcing the jamming elements 8 downwards until it has passed also through the jamming elements 16 to be thrust against the ground. After fixing the collar sleeve 14 by a stop 19 arranged in a hole 21, the percussive air tool 22 and the rod-clamping means are raised 0.3 to 0.5 m above the ground surface.

Thanks to the action of the force of gravity and the effort produced by the coil spring 10, the jamming elements 8 are pressed both against the housing 3 and the rod 24 whereby the percussive air tool 22 fails to slide downwards on the rod 24. The stop 19 is then replaced to a slot 20 for the collar sleeve 14 to move under the action of the spring 18 and cause the jamming elements to be displaced downwards and come into close contact with the housing 11 and the rod 24.

When the percussive air tool 22 starts to operate, impacts delivered by its hammer are taken up by the housing 3 of the impact load transmission assembly 1 wherefrom these impacts are transmitted through the jamming elements 8 to the rod 24 whereby these jamming elements 8 slip in the grooves 5 relative to the housing 3 to move closer together and lock on the rod 24, the rod-clamping means being thus locked. Under the action of the recoil force of the percussive air tool 22 the latter tends to move up the rod 24. However, the jamming elements 16 of the recoil force take up assembly 2 pressed to the housing 11 and the rod 24 by the coil spring 18 slip in the grooves 13 relative to the housing 11 to move toward each other and lock on the rod 24 in a likewise manner. Movement of the percussive air tool 22 relative to the rod 24 is thus prevented, whereas the rod 24 and the percussive air tool 22 affixed thereto by means of the rod-clamping means are caused to move down for the rod 24 to be driven into the ground.

When the rod-clamping means gets closer to the ground surface, its sleeve 14 bears against the ground by the collar portion thereof and stops. The percussive air tool 22 and the rod-clamping means continue their downward travel relative to the sleeve 14, the sleeve 14 acting to press on the jamming elements 16 and move them upwards in the grooves 13. The distance between the jamming elements tends to increase whereby the rod 24 is relieved from the clamping action. Because the jamming elements 8 of the impact load transmission assembly 1 fail to take up the recoil force, at the moment when the rod 24 is relieved from the clamping action of the jamming elements 16 the percussive air tool 22 together with the rod-clamping means tend to move up the rod 24 at a distance equal to the distance of displacement of the jamming elements 16 by the collar sleeve 14. A subsequent impact delivered by the hammer of the percussive air tool 22 acts to again jam the rod 24 in the rod-clamping means to drive the rod 24 further into the ground. The heretofore described cycle is recommenced until the rod is completely driven into the ground.

In order to retract the rod from the ground, the collar sleeve 14 is pressed inside the rod-clamping means to be fixed in this position by the stop 19 by inserting the stop 19 into the hole 21 of the collar sleeve 14.

Therewith, the jamming elements 16 are displaced upwards thereby failing to exert clamping action on the rod 24, the recoil force take up assembly 2 being thus out of operation. The percussive air tool 22 and the rod-clamping means are then mounted on the rod to be removed from the ground in an upside down position and lowered on the rod 24 to the ground. Upon starting the percussive air tool 22, impacts delivered by its hammer are imparted to the rod 24 by the jamming elements 8. Under the action of the impacts the percussive air tool 22 is caused to move together with the rod 24 upwards, and since the recoil force take up assembly 2 is out of action the recoil force is not taken up by the rod-clamping means whereby the percussive air tool 22 tends to move on the rod 24 downwards until it contacts the ground under the action of recoil forces and the forces of gravity subsequent to each impact delivered.

The heretofore described cycle is recommenced until the rod is completely out of the ground.

In view of the foregoing, the rod-clamping means embodying the present invention makes it possible to drive into the ground and retract therefrom substantially rod-like pieces by using a percussive air tool. The rod-clamping means described above provides stable and reliable locking and unlocking actions to increase the efficiency of driving rods into the ground and retracting the rods therefrom.

Figure 5:
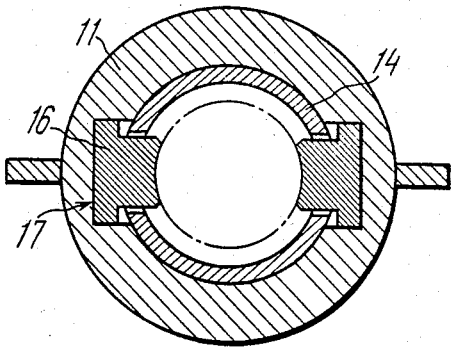
FIG. 5 is a cross-section taken along the line V—V in in FIG. 4.
Figure 6:
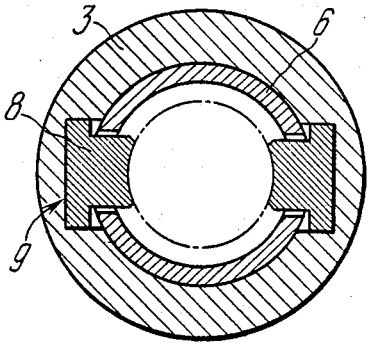
FIG. 6 is a cross-section taken along the line VI—VI in FIG. 4.
Figure 4:
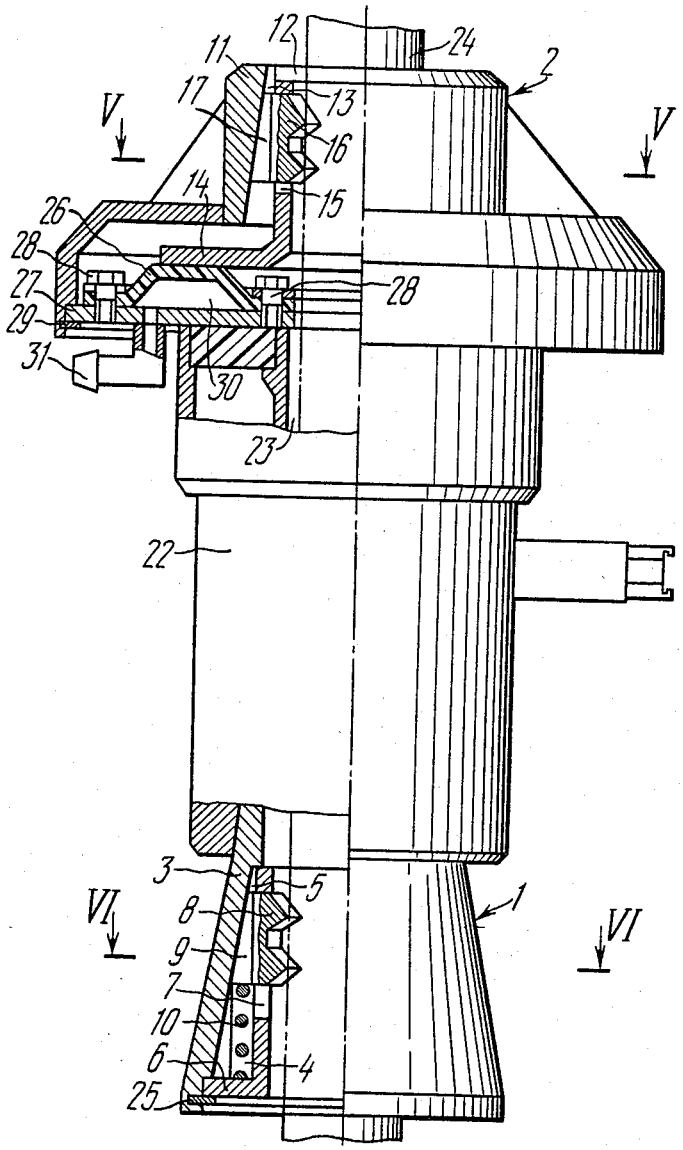
FIG. 4 illustrates a modified form of the rod-clamping means embodying the present invention wherein a recoil force take up means is arranged in the rear portion of the percussive air tool, a resilient means thereof having the form of a flexible membrane.

Referring now to FIGS. 4, 5 and 6, there is shown an alternative emodiment of the rod-clamping means of a percussive air tool for driving into the ground and removing therefrom rod-like pieces which comprises an impact load transmission assembly 1 mounted in the lower or forward portion of the percussive air tool 22, and a recoil force take up assembly 2 mounted in the upper or rear portion of the percussive air tool 22.

The impact load transmission assembly 1 comprises a housing 3 having a through axial cavity 4 the inner surface of which is provided with inclined grooves 5. Disposed inside the axial cavity 4 is a sleeve 6 having windows 7 on the side surface thereof. Jamming elements 8 having projections 9 adapted to move inside the inclined grooves 5 of the housing 3 are received by the windows 7 of the sleeve 6, the inner surfaces of the inclined grooves 5 and the mating surfaces of the projections 9 of the jamming elements may be either flat or cylindrical with the same radius of curvature; FIGS. 4 to 6 illustrating a modification with flat surfaces. Interposed between the jamming elements 8 and the sleeve 6 is a coil spring 10, the sleeve 6 being locked in position in the housing 3 by a retaining ring 25.

The recoil force take up assembly 2 comprises a housing 11 having a through axial cavity 12 the inner surface of which is provided with inclined grooves 13. Disposed inside the cavity 12 is a collar sleeve 14 having windows 15 on the side surface thereof. Jamming elements 16 having projections 17 slidable in the inclined grooves 13 of the housing 11 are received by the windows 15.

The inner surfaces of the inclined grooves 13 and the mating surfaces of the projections 17 of the jamming elements 16 may be either flat or cylindrical with substantially the same radius of curvature; FIGS. 4 to 6 showing an embodiment with flat surfaces.

A flexible membrane 26 is provided between the collar sleeve 14 and the housing 11, this membrane being attached by bolts 28 to a flange member 27 secured to the housing 11 by a retaining ring 29 to define therewith a chamber 30 communicable through a nipple 31 with a source of compressed air. The impact load transmission assembly 1 and the recoil force take up assembly 2 are arranged such that the grooves 5 and 13 of their respective housings 3 and 11 are inclined in one direction. The rod-clamping means and the percussive air tool are rigidly interconnected and have a common axial bore 23 through which is passed a rod 24 to be driven into the ground.

The aforedescribed modification of the rod-clamping means is preferably used for driving rods into soft a ground. When driving rods into such ground, the rods tend to penetrate greater ground depth under the action of impacts delivered; the percussive air tool therefore must be raised on the rod being driven to a maximum possible height to reduce the number of lock-unlock actions of the rod-clamping means.

The rod-clamping means just described and illustrated in FIGS. 4, 5 and 6 operates in a manner somewhat distinct from the way the modification described with reference to FIGS. 1, 2 and 3 operates, the distinction residing in as follows.

Subsequent to placing the percussive air tool 22 on the ground the rod 24 to be driven is passed through the recoil force take up assembly 2, the axial bore 23, and the impact load transmission assembly 1 until the rod 24 thrusts against the ground. When no compressed air is supplied to the chamber 30, the flexible membrane 26 fails to prevent the jamming elements 16 from movement in the grooves 13 and therefore allows passage therethrough of the rod 24.

After the percussive air tool 22 is raised to a height of 0.5 to 0.7 m above the ground, compressed air is fed to the chamber 30 of the recoil force take up assembly 2 to act on the membrane 26.

Compressed air supplied to the chamber 30 causes the membrane 26 to bulge and thereby move the collar sleeve 14 upwards, which in turn shifts the jamming elements 16 in the grooves 13 of the housing 11 to press these elements both against the housing 11 and the rod 24 with a force determined by the effective area of the membrane and the pressure of compressed air, this force being necessarily greater than the recoil force of the percussive tool 22. This being so, the percussive air tool 22 is relialy locked on the rod 24 for the rod driving operation to run smoothly, because the recoil forces are taken up by the jamming elements 16 pressed by the membrane 26 to the housing 11.

When the pneumatic air tool 22 with the rod-clamping means gets too close to the ground, the operator cuts off the supply of compressed air to the chamber 30. By virtue of the fact that the efforts providing for fixing the jamming elements 16 relative to the housing 11 of the recoil force take up assembly 2 and the rod 24 are relieved, and thanks to that the impact load transmission assembly 1 fails to take up the recoil force, the percussive air tool 22 with the rod-clamping means is caused to move up the rod 24 under the action of these forces. After the percussive air tool 22 have been moved up the rod 24 a required distance, compressed air is again fed to the chamber 30 to lock the percussive air tool 22 on the rod 24.

In other respects, the modification of the rod-clamping means with reference to FIGS. 4, 5 and 6 operates in a manner similar to the one described with reference to the first modification.

No compressed air is fed to the chamber 30 of the recoil force take up assembly 2 for removing the rod from the ground. To effect the removal, the percussive air tool 22 is mounted on the rod with the impact load transmission assembly 1 in an upward facing position. Because the flexible membrane 26 fails to prevent the jamming elements 16 from sliding in the grooves 13, the rod passes freely through the recoil force take up assembly 2, and the percussive air tool is lowered on the ground.

Othersise, the operating principle for removing the rod from the ground is substantially similar to what has been heretofore described.

In view of the foregoing, the rod-clamping means of a percussive air tool for driving into the ground and retracting therefrom rod-like pieces embodying the present invention makes it possible to effect driving in and retracting of rods by applying axial loads to the side surfaces thereof. It further allows to automatically relocate the percussive tool on the rod being driven or withdrawn by using the rod driving force and the reactive recoil force.

Compared to the prior art rod-clamping means the device according to the invention provides highly stable and reliable rod locking and unlocking actions, and therefore improved efficiency of rod driving and removing operations.

What is claimed is:

1. A rod-clamping means of a percussive air tool for driving into the ground and removing therefrom rod-like elements comprising:

an assembly for transmitting impact loads to a rod being driven into the ground;

said impact load transmission assembly including a housing having a through axial cavity, a system of jamming elements, and a sleeve;

an assembly for taking up recoil forces from the percussive air tool;

said recoil force take up assembly including a housing having a through axial cavity, a system of jamming elements and a collar sleeve; and separate resilient means in the said two assemblies for urging said systems of jamming elèments to said housings and said rod.

2. A rod-clamping means as defined in claim 1 wherein the sleeves of the two assemblies have windows adapted to receive said jamming elements, the jamming elements having projecting portions.

3. A rod-clamping means as defined in claim 1, wherein inner surfaces of the housings have inclined grooves adapted to slidingly receive the projecting portions of said jamming elements.

4. A rod-clamping means as defined in claim 2 wherein inner surfaces of the housings have inclined grooves adapted to slidingly receive the projecting portions of said jamming elements.

5. A rod-clamping means as defined in claim 1 wherein said resilient means of the impact load transmission assembly is interposed between said jamming elements and said sleeve, said resilient means of the recoil force take up assembly being interposed between its housing and said collar sleeve.

6. A rod-clamping means as defined in claim 3 wherein said impact load transmission and recoil force take up assemblies are interconnected so that the grooves provided in their respective housings are inclined in the opposite directions.

7. A rod-clamping means as defined in claim 4 wherein said recoil force take up assemblly is arranged in the rear portion of the percussive air tool, its resilient means having the form of a flexible membrane defining with the housing a chamber communicable with a source of compressed air, said grooves in the housings of said recoil force take up and impact load transmission assemblies being inclined in one direction.

8. A rod-clamping means as defined in claim 4 wherein mating surfaces of said inclined grooves and said projections of the jamming elements are flat.

9. A rod-clamping means as defined in claim 3 wherein mating surfaces of said inclined grooves and said projections of the jamming elements are cylindrical with equal radius of curvature.

* * * * *